US005826752A

United States Patent [19]

Latimer

[11] Patent Number: 5,826,752

[45] Date of Patent: Oct. 27, 1998

[54] FLUID DESPENSING AND SHIPPING CONTAINER SYSTEM AND METHODS

[76] Inventor: Scott Latimer, 2914 Santa Anna, Dallas, Tex. 75228

[21] Appl. No.: 447,482

[22] Filed: May 23, 1995

[51] Int. Cl.[6] ..... B65D 35/00

[52] U.S. Cl. ..... 222/105; 220/462; 222/158; 222/183; 229/120.011

[58] Field of Search ..... 222/105, 183, 222/158; 220/403, 465, 462; 229/101, 101.2, 120.011

[56] References Cited

U.S. PATENT DOCUMENTS

| | | | |
|---|---|---|---|
| 80,307 | 7/1868 | Reeve | 222/158 |
| 459,534 | 9/1891 | Shaffner | 222/158 |
| 598,345 | 2/1898 | Kellom | 222/158 X |
| 2,073,930 | 3/1937 | Gray . | |
| 2,134,865 | 11/1938 | Essery . | |
| 3,087,655 | 4/1963 | Scholle | 222/105 X |
| 3,173,579 | 3/1965 | Curie et al. | 222/105 |
| 3,186,622 | 6/1965 | Palmer . | |
| 3,227,322 | 1/1966 | Crain | 220/462 X |
| 3,233,817 | 2/1966 | Casady . | |
| 3,234,107 | 2/1966 | Kaufman . | |
| 3,253,764 | 5/1966 | Goetschius et al. | 222/105 X |
| 3,331,533 | 7/1967 | Krugger . | |
| 3,349,960 | 10/1967 | Ketler . | |
| 3,363,807 | 1/1968 | Powell | 222/183 X |
| 3,370,774 | 2/1968 | Hopf | 222/183 X |
| 3,453,033 | 7/1969 | Goss . | |
| 3,758,021 | 9/1973 | Gordon-Ross | 229/120.011 |
| 3,964,636 | 6/1976 | Rehrig . | |
| 4,412,616 | 11/1983 | Williams . | |
| 4,418,823 | 12/1983 | Romick . | |
| 4,623,075 | 11/1986 | Riley | 222/105 X |
| 4,913,291 | 4/1990 | Schuster | 229/120.011 |
| 5,085,346 | 2/1992 | Wright . | |
| 5,137,175 | 8/1992 | Kowalski et al. . | |
| 5,186,359 | 2/1993 | Brown et al. | 222/183 X |
| 5,377,876 | 1/1995 | Smernoff | 222/183 X |
| 5,645,163 | 7/1997 | Werth | 229/120.011 X |

FOREIGN PATENT DOCUMENTS

| | | | |
|---|---|---|---|
| 1468673 | 2/1967 | France | 222/105 |

*Primary Examiner*—Kevin P. Shaver
*Attorney, Agent, or Firm*—R. Darryl Burke; Worsham, Forsythe & Wooldrige

[57] ABSTRACT

An apparatus for containing and dispensing fluids comprises a collapsible, fluid-tight bag having an bag internal volume for storing fluid and at least one opening thereto, dispensing mechanism positioned one opening of the at least one opening for selectively dispensing fluid from the collapsible, fluid-tight bag; and a rigid container having a container internal volume and a partition to divide the container internal volume into a first chamber and a second chamber, the partition having an opening, the dispensing mechanism extending through the opening and secured in the opening, the collapsible, fluid-tight bag positioned in the first chamber, wherein the second chamber is removable. The bag is formed of a flexible plastic material. The dispensing mechanism is a spigot that has a neck mechanically coupled to the opening of the bag, whereby the spigot is in fluid communication with the container internal volume. A method of making a container for shipping and dispensing bulk liquids comprises the steps of manufacturing a container having a protective housing and a main housing with an opening therebetween, the protective housing forming a protective internal cavity, the main housing forming a main internal cavity, the protective housing is removable; positioning a fluid-tight, collapsible bag inside the main housing, the fluid-tight, collapsible bag having a dispensing apparatus; filling the fluid-tight, collapsible bag with a liquid; extending the dispensing apparatus through an opening in a surface of the main housing to make the main internal cavity to be in fluid communication with the protective internal cavity with a dispensing mechanism and passing the dispensing mechanism through the opening to extend from the first chamber into the second chamber; closing the container whereby it can be stacked or shipped without damaging the dispensing apparatus; and selectably removing the protective housing.

42 Claims, 8 Drawing Sheets

FLUID DESPENSING AND SHIPPING CONTAINER SYSTEM AND METHODS

PARTIAL WAIVER OF COPYRIGHT PURSUANT TO 1077 O.G. 22 (Mar. 20, 1987)

© Copyright, Scott Latimer 1995. All of the material in this patent application is subject to copyright protection under the copyright laws of the United States and of other countries. As of the first effective filing date of the present application, this material is protected as unpublished material.

However, permission to copy this material is hereby granted to the extent that the owner of the copyright rights has no objection to the facsimile reproduction by anyone of the patent document or patent disclosure, as it appears in the United States Patent and Trademark Office patent file or records, but otherwise reserves all copyright rights whatsoever.

FIELD OF INVENTION

The present invention relates to fluid dispensing and shipping container systems and methods that are used to handle, contain, and ship fluids, especially those fluids used for cleaning purposes.

BACKGROUND

The transportation, handling, and containing of fluids, such as modern industrial cleaning fluids, is a major concern of businesses, restaurants, and industrial facilities alike. The large volume of cleaning fluids, etc., required for commercial facilities dictates the purchase and storage of these fluids in bulk quantities. The concern is compounded when the fluids are toxic or otherwise unhealthy, such as industrial strength solvents. This concern is further heightened when these fluids are purchased, stored, and transferred in large quantities, which makes handling of the fluids difficult, especially in extracting small quantities for actual use.

SUMMARY

An apparatus for containing and dispensing a fluid comprises a collapsible container forming an interior volume to store varying amounts of the fluid, a main housing forming a main cavity to house the collapsible container, and a protective housing to protect the dispensing apparatus (e.g., spigot or nozzle) seated in the first opening of the first surface of the main housing. The collapsible container has a dispensing apparatus (e.g., spigot or nozzle) that selectively permits dispensing of the fluid from the collapsible container. The main housing has a first surface with a first opening therein. The dispensing apparatus (e.g., spigot or nozzle) is seated in the first opening, which has a perimeter. The protective housing has a perimeter edge that selectably joins with the perimeter of the first surface of the main housing. The collapsible container is a fluid-tight (permeable and/or non-permeable), transparent, flexible sheet material (e.g., plastic).

The main housing in preferred embodiments is also comprised of a second surface, a third surface, a fourth surface, a fifth surface and a sixth surface that combine to form a box to store the collapsible container. The first surface, second surface, third surface, fourth surface, fifth surface, and sixth surface are substantially planer. The main housing and protective housing are preferably formed of corrugated cardboard paper. A rack may be used having at least one horizontal shelf to hold the main housing. The main housing and protective housing in preferred embodiments are formed of a single sheet of sheet material (e.g., corrugated cardboard material). Preferred embodiments have at least one opening through which the collapsible container can be viewed. The first surface has a first portion of the perimeter (e.g., multilayered) that is tangential to the opening perimeter of the opening. Preferred embodiments of the dispensing apparatus (e.g., spigot, nozzle, or pump) comprise a measuring volume in communication with the internal cavity of the collapsible container to measure an amount of fluid selectively dispensed by the dispensing apparatus (e.g., spigot, nozzle, or pump) prior to the dispensing.

Preferred methods of making a container for shipping and dispensing bulk liquids comprise the following steps of: (a) manufacturing a container having a protective housing and a main housing with an opening therebetween, the protective housing forming a protective internal cavity, the main housing forming a main internal cavity, the protective housing is removable; (b) positioning a fluid-tight, collapsible bag inside the main housing, the fluid-tight, collapsible bag having a dispensing apparatus (e.g., nozzle, spigot, pump); (c) filling the fluid-tight, collapsible bag with a liquid; (d) extending the dispensing apparatus through an opening in a surface of the main housing to make the main internal cavity to be in fluid communication with the protective internal cavity with a dispensing apparatus (e.g., spigot, nozzle, or pump) and passing the dispensing apparatus (e.g., spigot, nozzle, or pump) through the opening to extend from the first chamber into the second chamber; (e) closing the container whereby it can be stacked or shipped without damaging the dispensing apparatus (e.g., spigot, nozzle, or pump); and (f) selectably removing the protective housing.

Preferred embodiments provide a number of advantages. As discussed above, preferred embodiments are comprised of a first compartment (e.g., main storage housing) and a second compartment (e.g., protective housing), one of which (e.g., protective housing) may be removed via the use of perforations or a tear tab, which reveals one side of the other compartment.

The removable compartment can be used for a variety of purposes, such as to house items for shipment that are designed to be used in conjunction with the material contained in the first compartment (e.g., spray bottles, gloves, masks, Material Safety Data Sheets, safety equipment, and utensils). The removable compartment can also be used to protect view holes or stripes on an exterior surface of the first compartment, which is preferably exposed to the interior volume of the second compartment during shipment. The removable compartment can, once removed, serve as a carrying and storage box for items contained therein. The removable compartment can be used to protect dispensing mechanisms connected to the inside exterior of the second compartment during shipment. Preferred embodiments mount the dispensing apparatus (e.g., spigot, nozzle, or pump) of the collapsible container in a manner that, once assembled and filed with fluid, the dispensing apparatus (e.g., spigot, nozzle, or pump) does not have to be moved at all, such as between shipping and dispensing positions. The protective housing protects the dispensing apparatus (e.g., spigot, nozzle, or pump) during shipment and is then selectably removed to allow the dispensing apparatus (e.g., spigot, nozzle, or pump) to be used normally. In short, when the container is to be used, the second chamber is opened to expose the dispensing apparatus (e.g., spigot, nozzle, or pump) and provide access to the dispensing apparatus (e.g., spigot, nozzle, or pump) for dispensing of fluid from the collapsible tank inside the container. Note the protective housing can be partially opened or completely removed to expose the dispensing apparatus. In addition, the position of the dispensing apparatus is at the very bottom of a first surface used to partition the main housing from the protective housing provides for maximum drainage of fluid from collapsible container housed by the main housing. Furthermore, the bottom and/or top edges of the first surface are reinforced with a plurality of layers that individually and collectively reinforce the bottom and/or top edges of the first surface. An extra reinforcement flap of sheet material provides additional reinforcement.

Dispensing mechanisms may be permanently seated at the base of the primary compartment by cutting a half circle or square at the bottom of the inside dividing wall. Closure of the preferred bottom box flaps will serve to lock dispensing mechanisms securely into place. As a function of placing the dispensing mechanism at the very base of the dispensing box, fluids or powders can be completely drained from the second compartment. In preferred box dispensing applications, the perforated dispensing mechanism opening is tangent to portions of the bottom score of the box. Alternate preferred embodiments may be positioned elsewhere, such as at least 1" from the bottom score of the box. Hand-powered and automatic pumps of various types could also be used as a dispensing mechanism to remove fluid from the box, in which case the dispensing mechanism opening could be positioned in any number of places in the box. Locking the dispensing mechanisms into place by sealing the bottom flaps around it, facilitates larger dispensing mechanisms and makes all dispensing mechanisms more stable and easier to use. By using the preferred flap closure to lock the dispensing mechanism into place, automated production is facilitated by dropping the collapsible plastic bag into the second compartment with the dispensing mechanism falling into the half circle on the dividing wall.

Preferred embodiments can also be advantageously placed on a shelf or any other support, such that dispensing mechanisms (e.g., nozzle or spigot) of the fluid container and dispensing system extend over the edge. To dispense fluid from the container, the dispensing mechanism is selectively operated to open the flow of fluid from the tank.

Another advantage of the preferred embodiments is that the amount of plastic material for the container can be substantially reduced relative to a shipping and dispensing container formed entirely of plastic. The outer container and insert, which can be formed of a corrugated sheet material, provides the structural rigidity. The bag can be formed of light-weight plastic and provides a fluid-tight reservoir.

In addition, preferred embodiments provide a one piece box design with interior and exterior glue joints that allow a two compartment box to be made without use of inserts or dividers.

Other advantages of the invention and/or inventions described herein will be explained in greater detail below.

BRIEF DESCRIPTION OF THE DRAWINGS

The accompanying drawings are incorporated into and form a part of the specification to illustrate several examples of the present inventions. These drawings together with the description serve to explain the principles of the inventions. The drawings are only for the purpose of illustrating preferred and alternative examples of how the inventions can be made and used and are not to be construed as limiting the inventions to only the illustrated and described examples. Further features and advantages will become apparent from the following and more particular description of the various embodiments of the invention, as illustrated in the accompanying drawings, wherein.

DETAILED DESCRIPTION OF THE PREFERRED EMBODIMENT

Figure 1A:
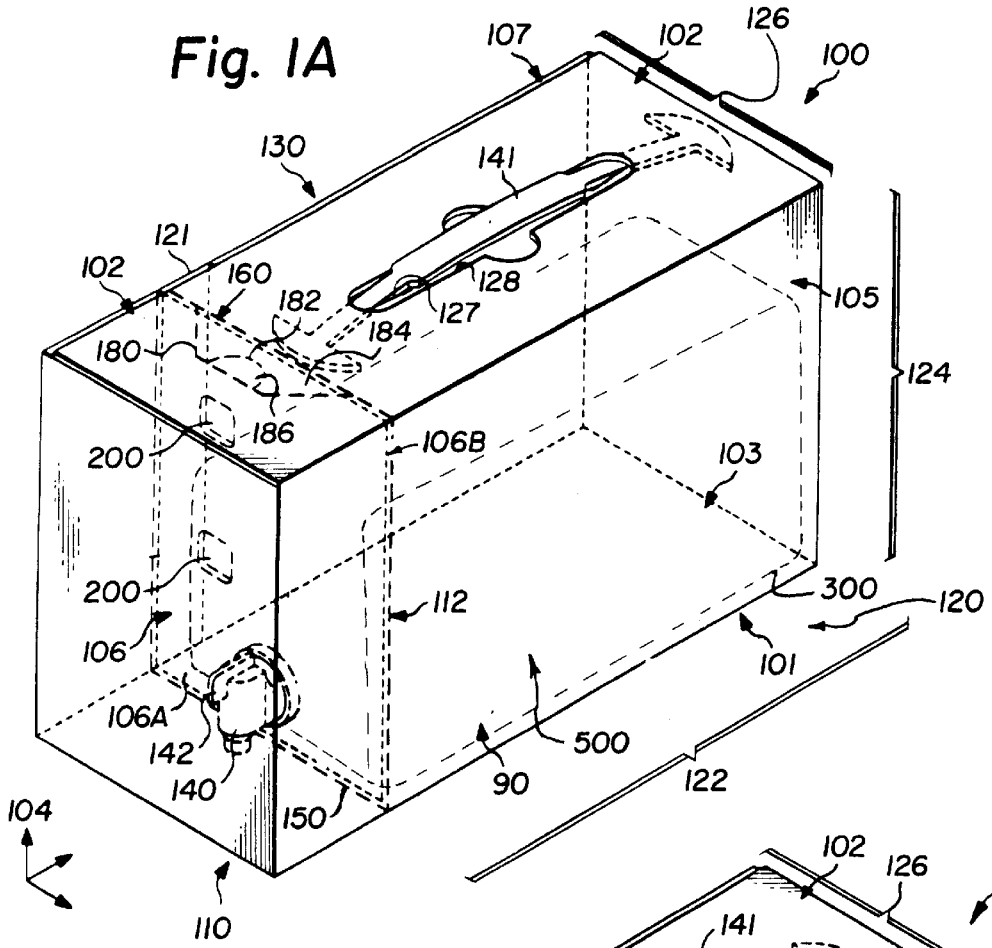
FIGS. 1A and 1B are perspective illustrations of a preferred embodiment of a fluid container and dispensing system 100, before and after protective housing 110 has been removed.

The present inventions will be described by referring to apparatus and methods showing various examples of how the inventions can be made and used. When possible, like reference characters are used throughout the several views of the drawing to indicate like or corresponding parts.

Figure 1B:
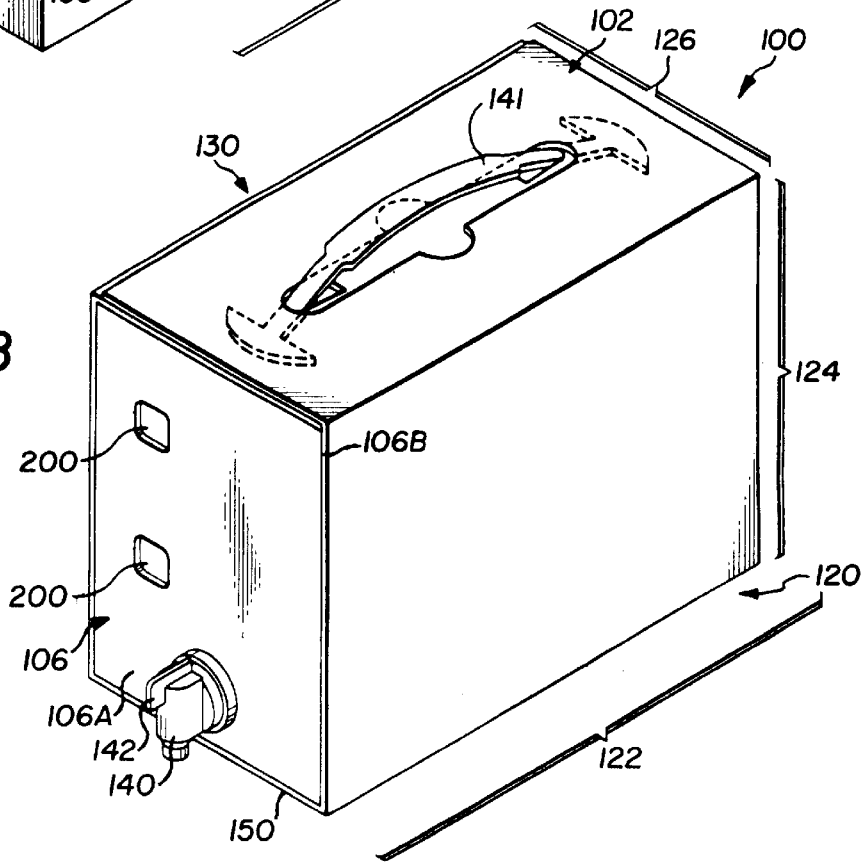
Figure 5A:
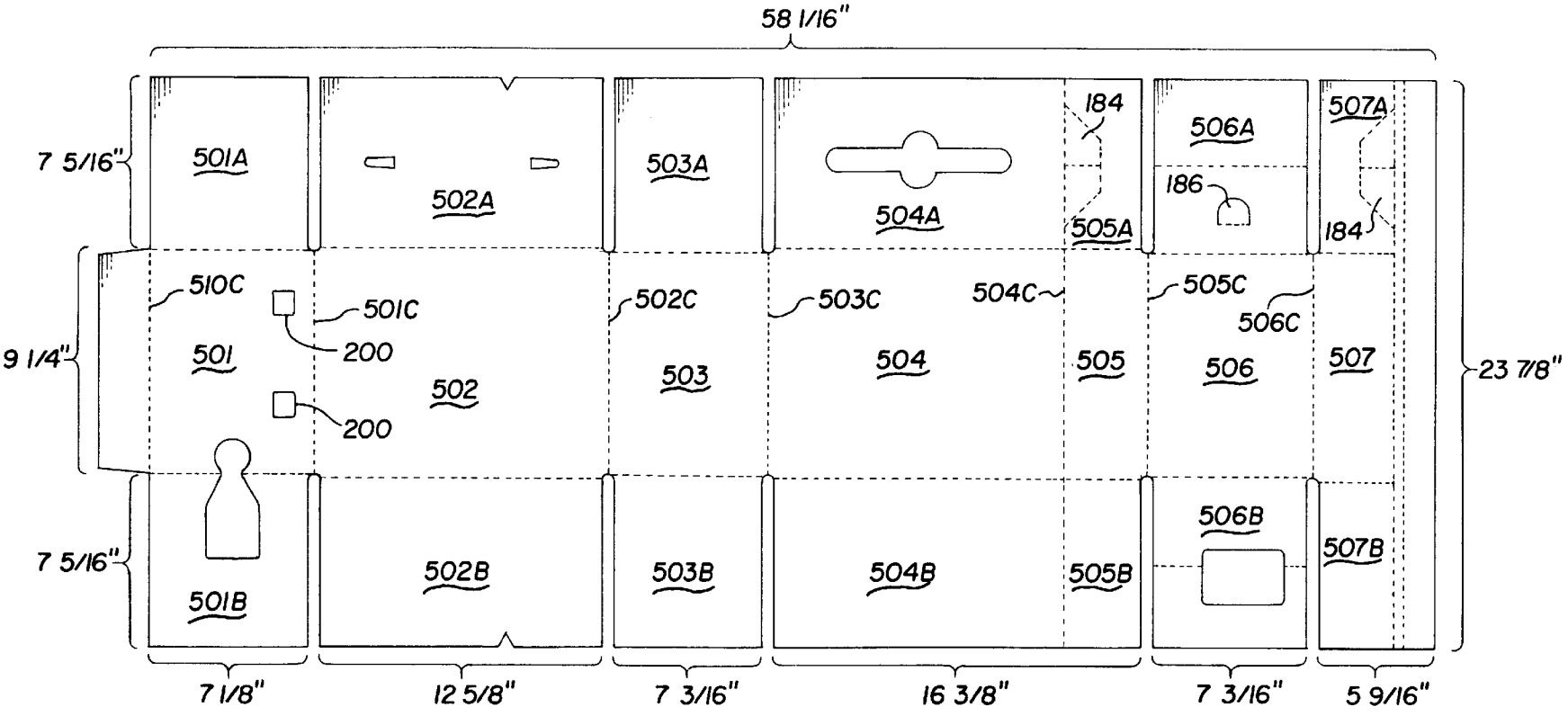
FIG. 5A is an illustration showing a single sheet planar cut-out used to fabricate the fluid container and dispensing system 100 shown in FIGS. 1A, 1B, 2, 3A, 3B, 3C, and 3D.

FIGS. 1A and 1B are perspective illustrations of a preferred embodiment of a fluid container and dispensing system 100, before and after one of the two housings (e.g., protective housing 110) has been removed. Fluid container and dispensing system 100 is generally comprised of a first compartment or main housing 120 and a second compartment or protective housing 110. Protective housing 110 and main housing 120 are preferably formed of a single sheet (a top view of which is shown in FIG. 5A) of thin material (e.g., corrugated cardboard paper), but may actually be manufactured out of two or more sheets of corrugated cardboard paper. Preferred embodiments provide a one piece box design with interior and exterior glue joints allowing a two compartment box to be made without use of inserts or dividers. Note the use of a single sheet of material reduces manufacturing costs of fluid container and dispensing system 100 by reducing the number of steps needed to manufacture the sheet of paper as well as the resulting fluid container and dispensing system 100. The one piece box design generally provides greater structural stability, in part, because of the nature of the continuous materials reinforces the multilayered portions of the box, especially when combined with the portion of the sheet of material (second surface 106) used to divide the two housings. When protective housing 110 and main housing 120 are manufactured from a single sheet of material, flap 130 in preferred embodiments extends across the first surface 102 of main housing 120 as well as first surface 102 of protective housing 110, which is preferably facing the upward direction 104. Main housing 120 has length 122 (e.g., 10"), width 126 (e.g., 7"), and height 124 (e.g., 10"), which may vary, depending upon the need and internal volume of the container and dispensing system 100.

Preferred embodiments of fluid container and dispensing system 100 are comprised of third surface 101, fourth surface 103, fifth surface 105, and sixth surface 107 along with first surface 102 and second surface 106 combine to form a box. While all of the figures show one shape, six-sided rectangular boxes, of one embodiment of the fluid container and dispensing system 100 for use in shipping and dispensing bulk liquids 500, it is to be understood that other configurations and/or shapes could be used. Main housing 120 is preferably closed and sealed to form an internal cavity 90 that houses liquid container 300. Main housing 120 also supports liquid container (or bag 300), which is preferably a collapsible fluid container, bag, or tank. For purposes of description the liquid container will be referred to generically as liquid container or bag 300 to avoid confusion with main housing 120 in which it is housed. Bag 300 is shown as a collapsible, fluid-tight bag of sufficient strength to contain bulk liquids such as foods, beverages, chemicals, cleaners, soaps, petroleum products (e.g., motor oil) and other fluids handled in bulk form. Bag 300 may have an opening through which the liquids can be added or dispensed. Dispensing apparatus 140 (e.g., spigot, nozzle, or pump) is connected to the opening of bag 300. Dispensing apparatus 140 is of convention design well known to those skilled in the art. It is contemplated that other types of liquid containers of flexible or rigid material, or combinations thereof, could be used as the liquid container. Second surface 106 enables internal cavity 90 to be closed, even after protective housing 110 is removed. All surfaces are formed of rigid sheet material, such as corrugated cardboard, and are substantially planar that enable the fluid container and dispensing system 100 to support itself with bulk liquids or fluids 500 positioned inside liquid container or bag 300. Sheet material in preferred embodiments are preferably non-permeable or moisture-resistant. For instance, the application of a laminant or use of a plastic shrink wrap makes the sheet material used in fluid container and dispensing system 100 moisture resistant. As discussed above, corrugated sheet material is presently preferred, because it is biodegradable, inexpensive, and workable. However, it is to be understood that other materials can be appropriate for the present inventions. For example, plastics, foam board, and other suitable sheet or molded materials can be used as appropriate for greater strength or other purposes.

Seam 112 is easily breakable, so that protective housing 110 can be easily removed. Seam 112 is preferably perforated. Seam 112, however, can also be removed with a draw-string apparatus in which a string is buried in the material in such a fashion than when pulled seam 112 is broken. Protective housing 110 protects dispensing apparatus 140, such as a nozzle, a pump, or a spigot, which is preset in second surface 106 of main housing 120 (which is interior to protective housing 110 when protective housing 110 is attached to main housing 120). This is important for a variety of reasons, one of which is that it protects dispensing apparatus 140 from being damaged or snagged during shipment. This organization also allows fluid container and dispensing system 100 to be shipped in an easily stackable and storable fashion. In short, the protective housing 110 and main housing 120 formed a self-contained box (having a fluid container therein) when combined, which can be easily stacked on top of other similarly situated fluid container and dispensing system 100, stored in a rack (see FIG. 7), and/or on top of other boxes. As shown in FIGS. 1A and 1B, protective housing 110 and main housing 120 are rectangular boxes that combine to another rectangular box. In addition, main housing 120 has at least one opening 200 that provides a window that allows bag 300 (not shown in FIGS. 1A and 1B—see FIG. 3) that is housed within main housing 120 that preferably holds fluid or bulk liquids 500 (in FIGS. 3A, 3B, 3C, and 3D) that fluid container and dispensing system 100 dispenses to be viewed from the exterior of main housing 120. Opening(s) 200 are shown to be oval in shape in FIGS. 1A and 1B, but may be rectangular, circular, or any other shape as well. Opening(s) 200 may be closed with a transparent material (not shown) or left open, as it is in preferred embodiments. Bag 300 is preferably collapsible and comprised of a transparent material as well that permits the fluid level 132 that generally corresponds to the boundary of bag 300 (because all the air is removed from bag 300, which corresponds to the amount of bulk liquid or fluid 500 contained by bag 300 to be viewed via opening 120, which allows the amount of bulk liquid or fluid 500 contained by bag 300 to be observed from the outside of main housing 120 without having to open main housing 120 and look inside. While alternate container are possible, bag 300 is also preferably fluid-tight, flexible sheet, and sealed to form a reservoir for the storage of bulk liquid or fluid 500, before fluid 500 is dispensed via dispensing apparatus 140. Also, note opening 120 in preferred embodiments is angled to allow greater viewing of the level of bulk liquid or fluid 500 contained in bag 300 when fluid container and dispensing system 100 is positioned in an upright position. Similarly, the opening(s) 200 are also positioned at various heights from bottom edge 150, which allows greater viewing of the level of bulk liquid or fluid 500 contained in bag 300 when fluid container and dispensing system 100 is positioned in an upright position.

Dispensing apparatus 140, such as a nozzle, a pump, or a spigot, is seated in second surface 106 extremely close to bottom edge 150, which allows greater drainage with the help of gravity of fluid 500 contained in the bag 300 (not shown in FIGS. 1A and 1B) from bag 300 out through dispensing apparatus 140, such as a nozzle, a pump, or a spigot. Dispensing apparatus 140 are generally understood by those skilled in the art and are available from a number of manufactures, such as Scholle, Inc. For instance, U.S. Pat. No. 3,223,117, which is herein incorporated by reference, describes a particular nozzle or spigot that can be used for dispensing apparatus in preferred embodiments. Dispensing apparatus 140 in preferred embodiments are comprised of light material, such as plastic, and actually seated in second surface 106 with a first portion of dispensing apparatus 140 abutting up against interior surface 106A of second surface 106 and/or a second portion of dispensing apparatus 140 abutting up against exterior surface 106B of second surface 106 in a wedge-like fashion. Dispensing apparatus 140 extends joins bag 300 and extends through an opening for dispensing apparatus (which cannot be seen in FIGS. 1A and 1B—see FIGS. 3A, 3B, 3C, and 3D) to create a passageway that can be selectably opened between bag 300 and area outside of main housing 120 to drain bulk liquid or fluid 500 contained in fluid or container bag 300. Dispensing apparatus 140 can preferably be selectably turned on or off and/or adjusted with handle 142 to control the rate and amount of fluid 500 drained from bag 300.

Dispensing apparatus 140 in preferred embodiments are rigidly mounted to second surface 106 via dispensing apparatus opening 142. A keyhole shaped opening (not shown in FIGS. 1A and 1B—see FIG. 5) are formed partially in one layer that comprises third (bottom) surface 101. Dispensing apparatus opening 142 is of sufficient size to allow dispensing apparatus 140 to extend therethrough. A slot portion of dispensing apparatus opening 142 is selected to be of a size smaller than the dispensing apparatus 140, but about the same size as the neck of the dispensing apparatus 140. Dispensing apparatus 140 is connected to second surface 106 by inserting dispensing apparatus 140 through the round portion of the opening and then neck of dispensing apparatus 140 is slid into the slot portion of dispensing apparatus opening 142 into the position shown in FIGS. 1A, 1B, 2, 3A, 3B, and 3C. When additional layers third surface of main housing 120 are closed together, the neck of dispensing apparatus 140 is secured in dispensing apparatus opening 142. Preferably, as shown in the cross-sectional perspectives in FIGS. 3A, 3B, 3C, 3D, 6A, and 6C, the neck of dispensing apparatus 140 has spaced-apart flanges that engage the edges of the narrow portion of dispensing apparatus opening 142 and assist in retaining dispensing apparatus 140 in position. It is anticipated that dispensing apparatus opening 142 could be shaped other than as shown to achieve the purpose of inserting and mounting dispensing apparatus 140 in second surface 106 and that other methods of connecting dispensing apparatus 140 to second surface 106 could be used.

Figure 4A:
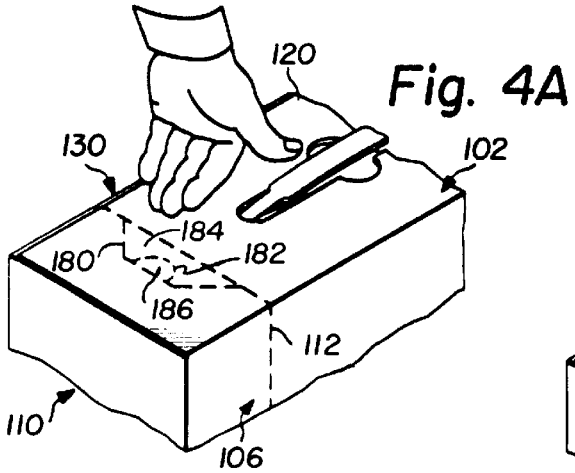
FIGS. 4A, 4B, and 4C are illustrations showing the process used to remove protective housing 110 and pull out and seat dispenser 140.
Figure 4B:
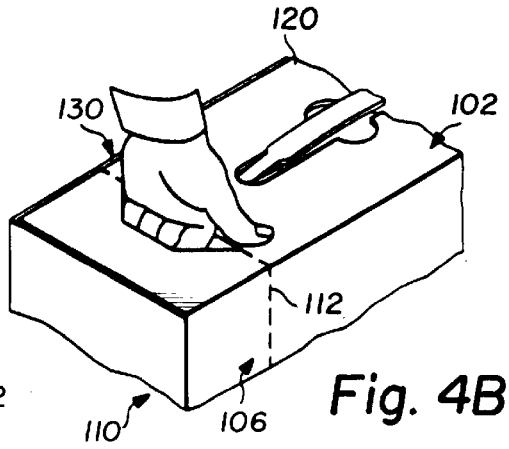
Figure 4C:
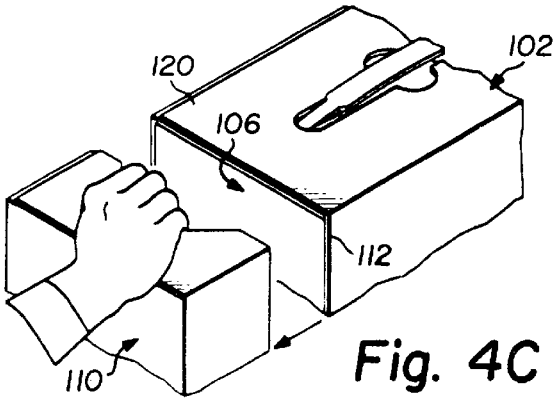

As shown in FIGS. 4A, 4B, and 4C, protective housing 110 is removed from main housing 120 by removing cut-out area 184 and finger-sized cut-out area 186 by opening seam 180 and seam 182. FIGS. 4A, 4B, and 4C are illustrations showing the process used to remove protective cover 110 and pull out and seat dispenser 140. Seam 180 is preferably perforated, so that one can punch in cut-out area 184 with a fist to split seam 180 open to remove cut-out area 184. Likewise, seam 182 is preferably perforated, so that one can punch in finger-sized cut-out area 186 to insert a finger to provide a hand-hold with which to pull and separate protective housing 110 from main housing 120. Handle 141 is also selectably pulled out when handle cut-out area 127 is separated from first surface 102 when seam 128 is split open. Preferred embodiments use handles manufactured by Allen Field Co., Inc. of 320 Broad Hollow Rd., Farmingdale, N.Y. 11735 and are approximately 9" in length. Seam 128 is also perforated to allow it to be easily split open. Alternate mechanisms could be used to remove protective housing 110, such as a draw string.

Figure 2:
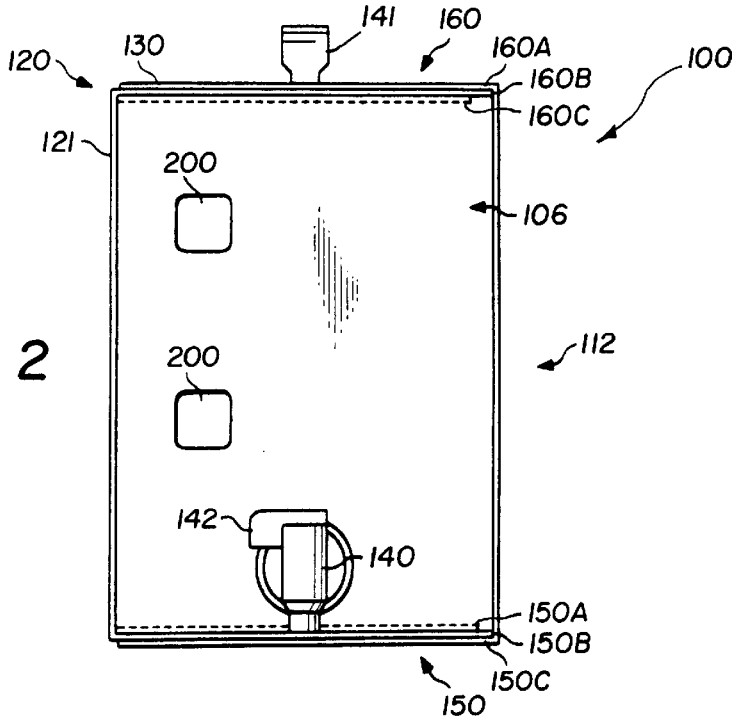
FIG. 2 is a frontal illustration of a preferred embodiment of main housing 120 of fluid container and dispensing system 100 when protective housing 110 has been removed.
Figure 3A:
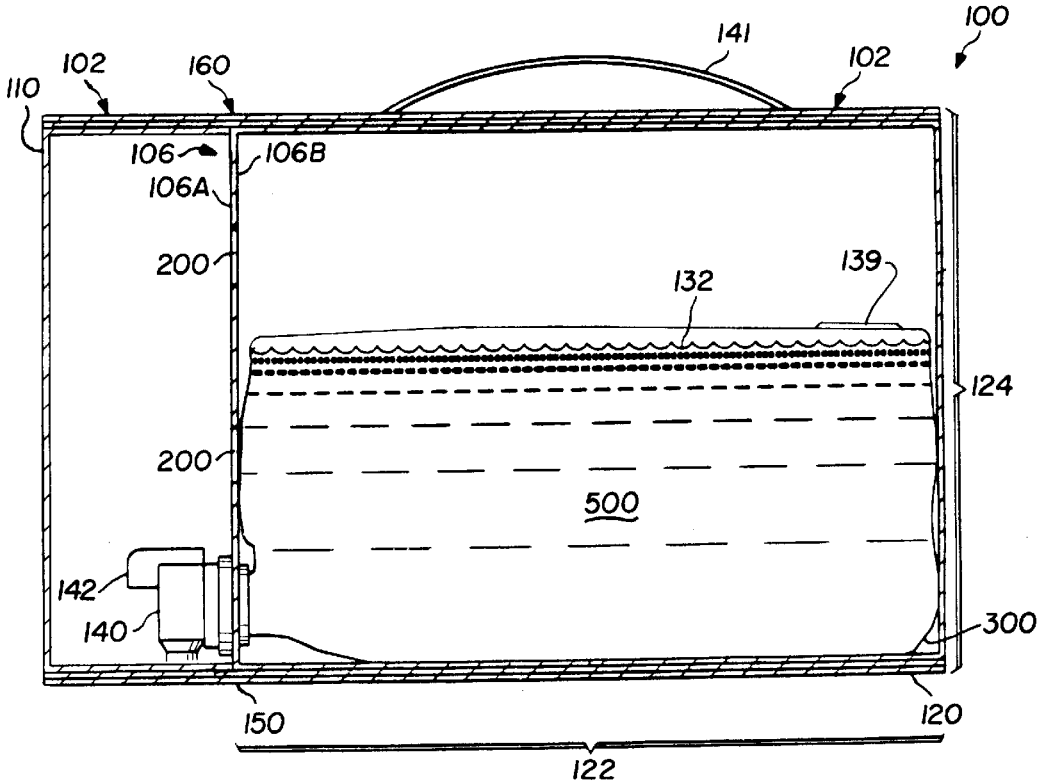
FIGS. 3A, 3B, 3C, and 3D are side-view illustration of a preferred embodiment of main housing 120 of fluid container and dispensing system 100 comprising protective housing 110 and main housing 120 before and after protective housing 110 has been removed.
Figure 3B:
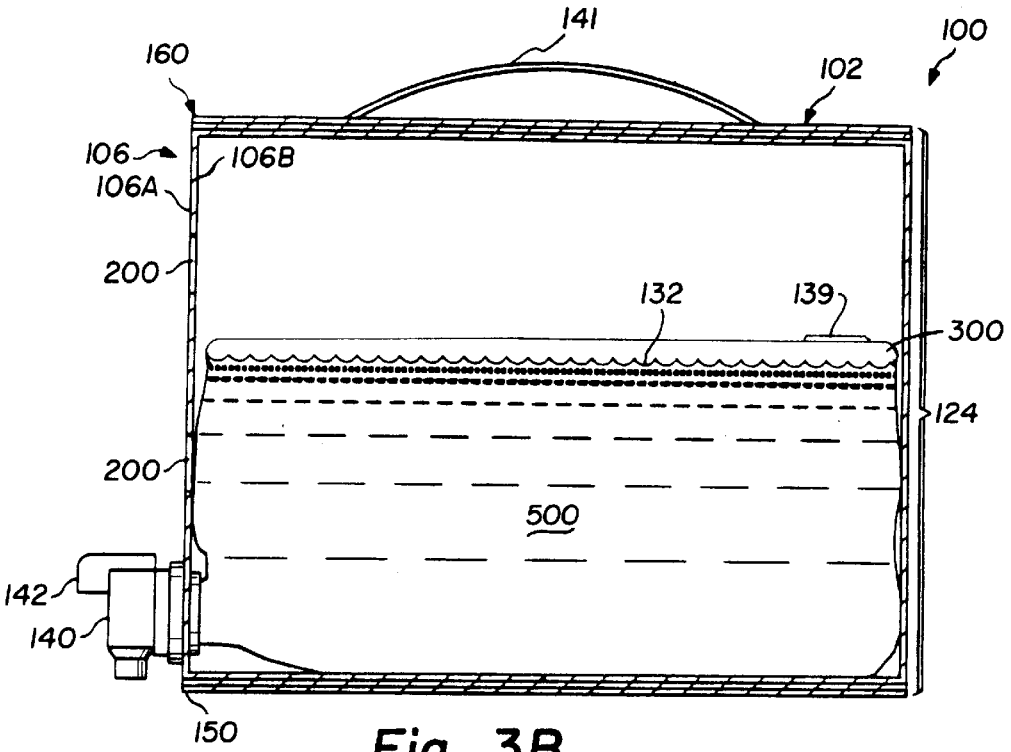
Figure 3C:
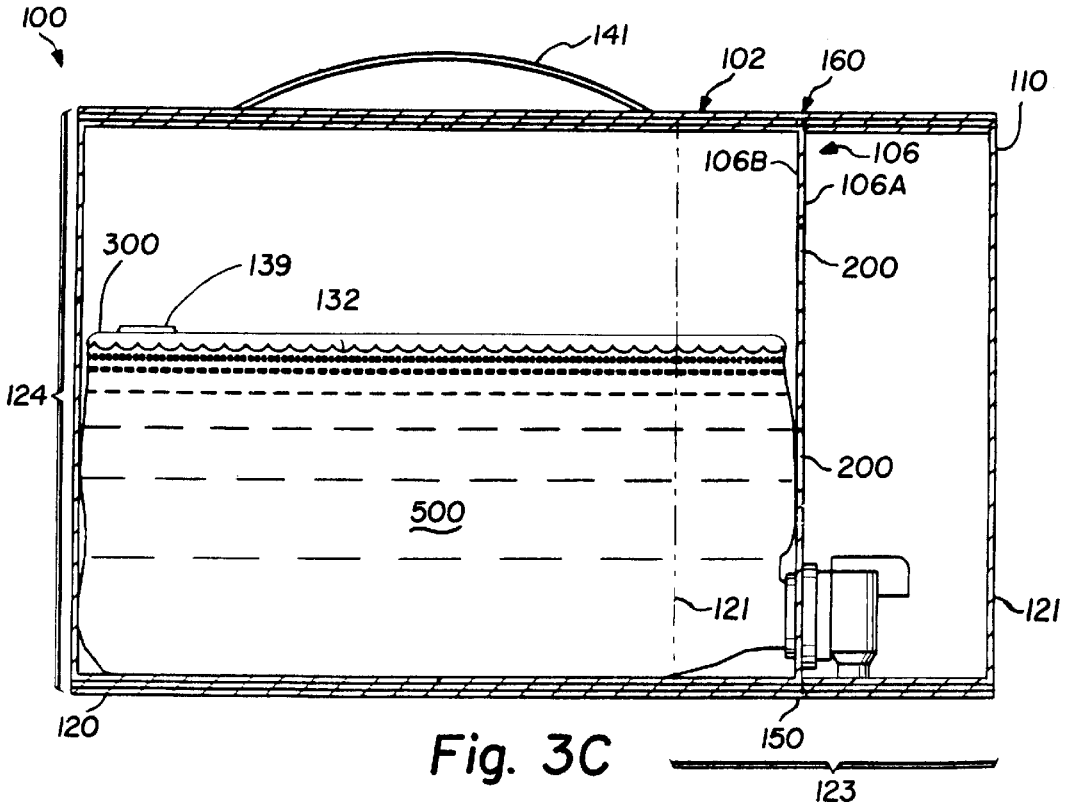
Figure 3D:
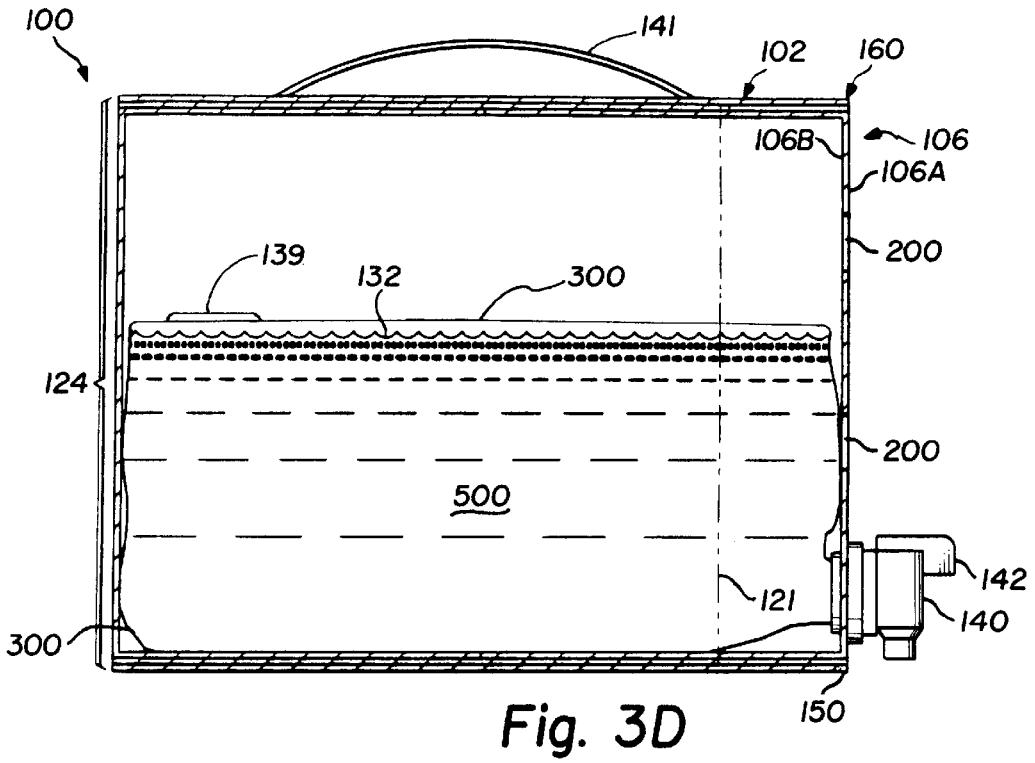

FIG. 2 is a frontal illustration of a preferred embodiment of main housing 120 of fluid container and dispensing system 100 when protective housing 110 has been removed. Note that bottom edge 150 is actually comprised a plurality of bottom layers (e.g., first bottom layer 150A, second bottom layer 150B, third bottom layer 150C). Likewise, top edge 160 is also comprised of a plurality of top layers (e.g., first top layer 160A, second top layer 160B, and third top layer 160C). The plurality of layers along bottom edge 150 and top edge 160 increase the strength and structure of top edge 160 and bottom edge 150. This is especially relevant for bottom edge 150, which is needed to support and secure dispensing apparatus 140. The plurality of layers also protects the overall integrity of the main housing 120, which houses bag 300.

FIGS. 3A, 3B, 3C, and 3D are side-view illustration of a preferred embodiment of protective housing 110 of fluid container and dispensing system 100 comprising protective housing 110 and main housing 120 before and after protective housing 110 has been removed. In particular, bag 300 is collapsible and filled with bulk liquid or fluid 500 to level 132 (that generally conforms with the outer boundary of bag 300), which will vary, but happens to be in FIGS. 3A, 3B, 3C, and 3D positioned between first and second openings 200. In addition, FIGS. 3C and 3D clearly shows the position of reinforcement flap 121 having width 123, which extends along first surface 102, along top edge 160 and along bottom edge 150, before and after protective housing 120 has been removed. Reinforcement flap 121 provides the second top layer 160B in top edge 160 (in FIG. 2) and second bottom layer 150B in bottom edge 150 (in FIG. 2). Reinforcement flap 121 is preferably glued to main housing 110 (but not to protective housing 120) with hot melt glue, but could be attached with any number of alternate mechanisms, such as staples, tape, etc. Note reinforcement flap 121 is also perforated along seam 112, so that it is split into when protective housing 110 and main housing 120 are separated from one another. Note second opening 139 in bag 300 allows bag 300 to be selectably refilled.

Figure 5B:
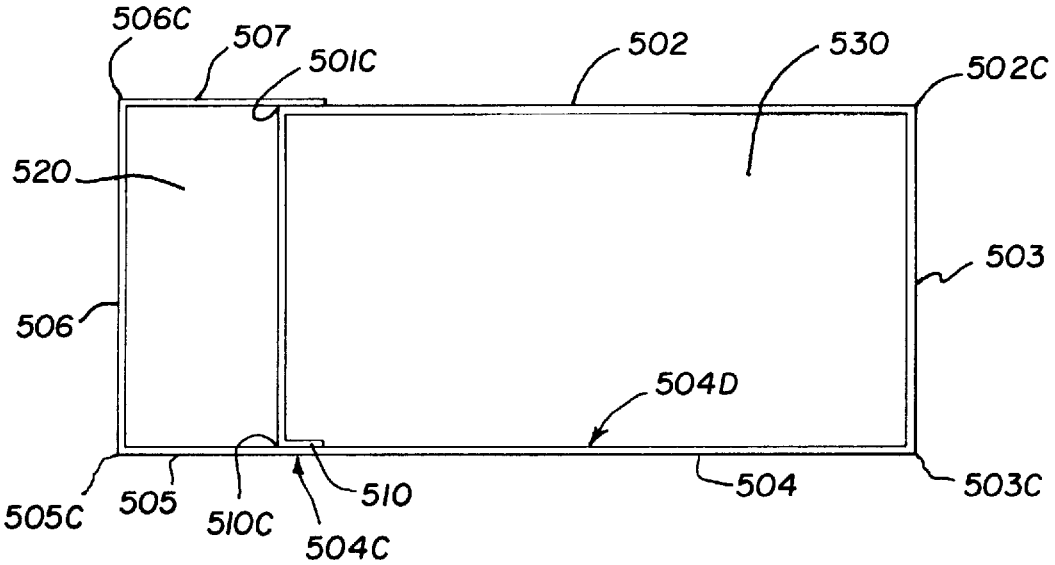
FIG. 5B is an illustration shown a see-through, side view of the single sheet cut 700 folded to fabricate the fluid container and dispensing system 100 shown in FIGS. 1A, 1B, 2, 3A, 3B, 3C, and 3D.

FIG. 5A is an illustration showing a single sheet planar cut-out 700 used to fabricate the fluid container and dispensing system 100 shown in FIGS. 1A, 1B, 2, 3A, 3B, 3C, and 3D. FIGURE 5B is an illustration shown a see-through, side view of the single sheet cut 700 folded to fabricate the fluid container and dispensing system 100 shown in FIGS. 1A, lB, 2, 3A, 3B, 3C, and 3D. First surface 102, second surface 106, third surface 101, fourth surface 103, fifth surface 105, and sixth surface 107 are formed by folding the sheet material into four panel sections and joining two of the panel sections together. Referring to FIGS. 5A and 5B, single sheet cut 700 is comprised of a plurality of subsections, which are numbered in FIG. 5A. To create the preferred embodiment discussed above, the following steps are performed: portion 510 is folded along score 510C and glued to an interior surface 504D of portion 504, portion 501 is folded along score 501C to form second surface 106(in FIG. 3A), portion 502 is folded along score 502C to form sixth surface 107, portion 503 is folded along score 503C to form fifth surface 105, portion 504 and portion 505 are folded along score 505C, (note portion 504 is not folded along score 504C), portion 506 is folded along score 506C, portion 507 is glued to an exterior surface 502D of portion 502. Collapsible container 300, preferably filled with fluid, is formed (not shown in FIGS. 5A, 5B, and 5C) is placed in the interior volume of volume 530 (of main housing 120 in FIGS. 1A, 1B, 2, 3A, 3B, 3C, and 3D). Dispensing apparatus 140 is positioned to extend through dispensing apparatus opening 142 and turned to the side (if needed). Flaps 501A, 501B, 502A, 502B, 503A, 503B, 504A, 504B, 505A, 505B, 506A, 506B, 507A, and 507B are folded along the other scores to enclose collapsible container 300 and otherwise close the entire assembly and glued together. Note scores 501C, 502C, and 505C are preferably extra heavy scores. Other scores in FIG. 5A are perforated to make removing portions outlined easier. All scores are preferably 8 point laser.

Figure 5C:
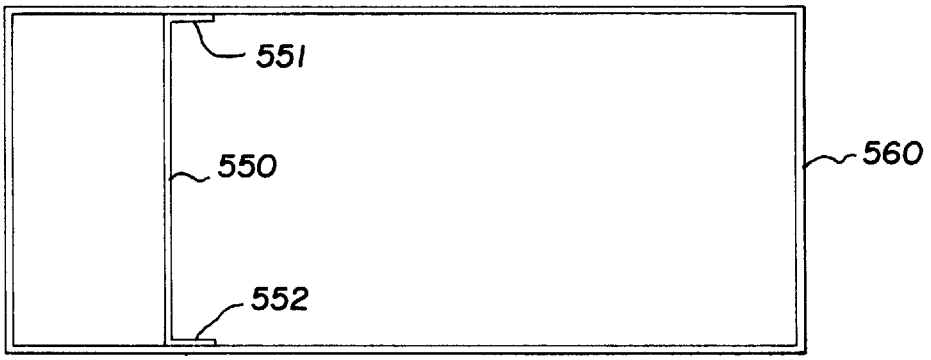
FIG. 5C is an alternate illustration shown a see-through, side view of the a folded box in which a separate, inserted divider 520 is inserted in place to fabricate the fluid container and dispensing system 100 shown in FIGS. 1A, 1B, 2, 3A, 3B, 3C, and 3D.

FIG. 5C is an alternate illustration shown a see-through, side view of the a folded box in which a separate, inserted divider 550 is inserted in place in a typical box 560 to fabricate the fluid container and dispensing system 100 shown in FIGS. 1A, 1B, 2, 3A, 3B, 3C, and 3D. Divider 550 is glued or otherwise attached at 551 and 552. Alternate preferred embodiments could be formed from multiple pieces joined together by tabs or otherwise.

Figure 6A:
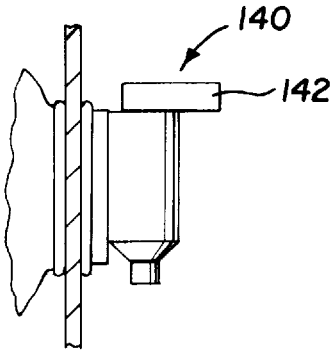
FIGS. 6A, 6B, 6C, and 6D are illustrations showing cross-section and frontal views of dispensing apparatus 140 (e.g., nozzle or spigot) used in a preferred embodiment.
Figure 6B:
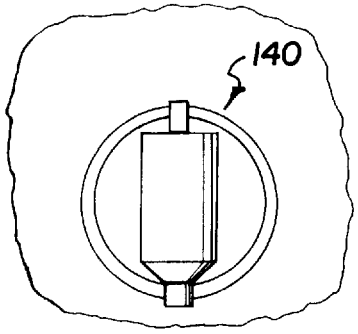
Figure 6C:
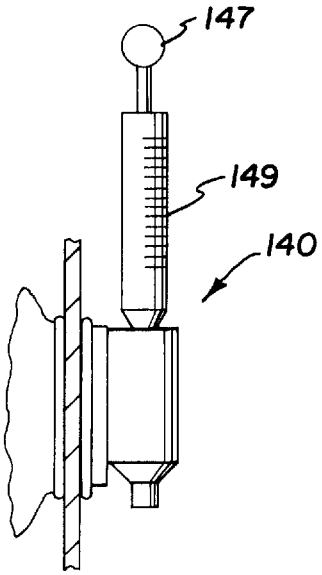
Figure 6D:
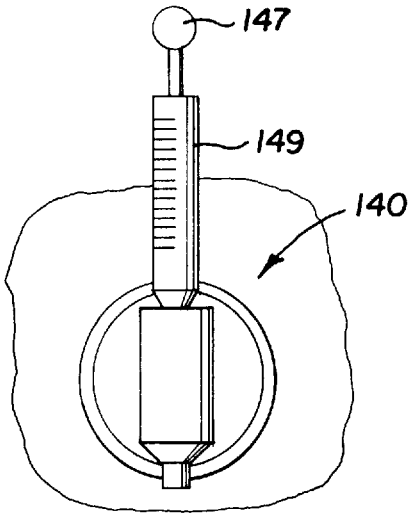

FIGS. 6A, 6B, 6C, and 6D are illustrations showing cross-section and frontal views of alternate embodiments of dispensing apparatus 140 used in preferred embodiments. Note, as shown in FIGS. 6C and 6D, dispensing apparatus 140 may also have a measuring apparatus, such as cylinder 149 with markings on the side and plunger 147, to regulate the flow of fluid.

Figure 7:
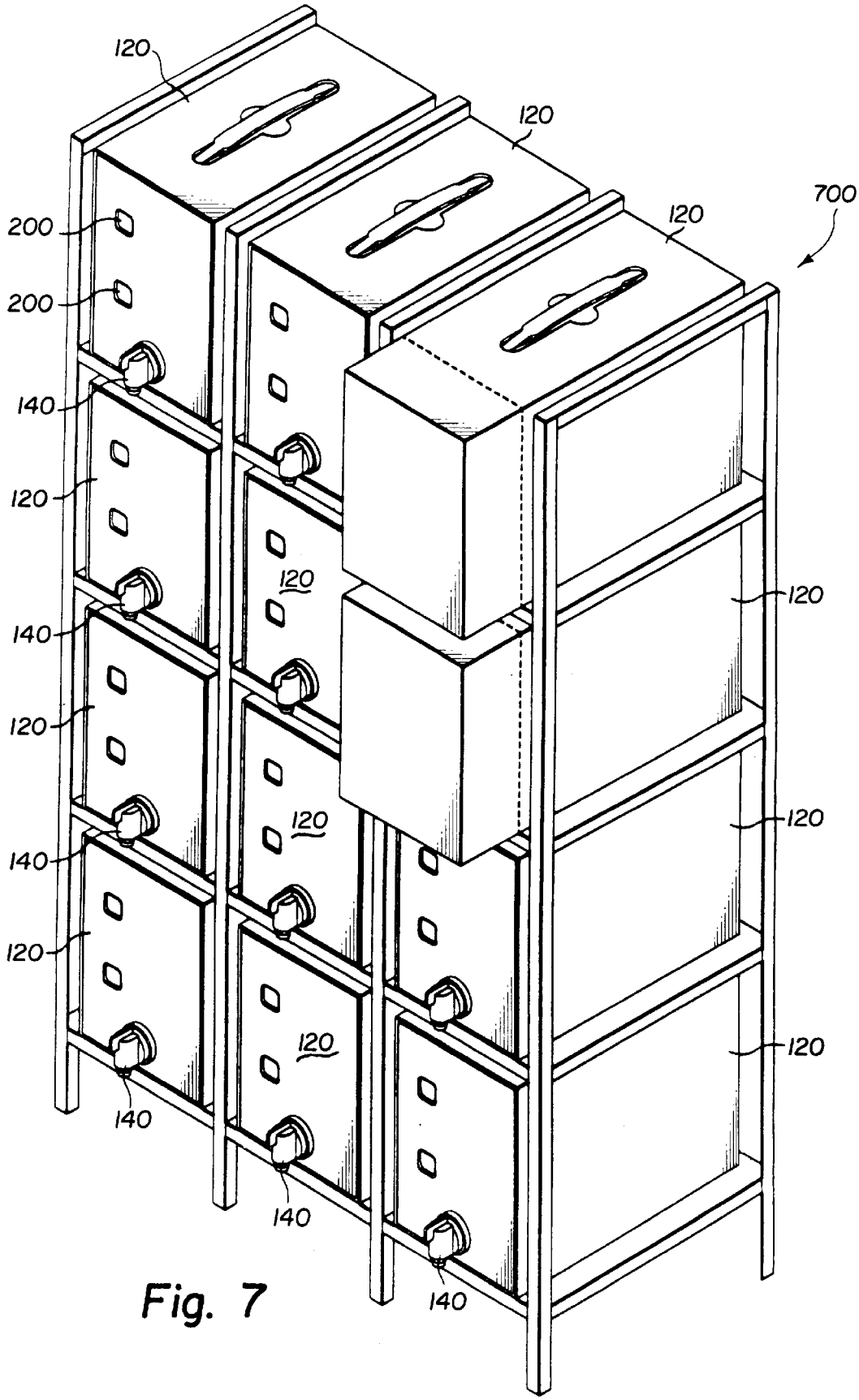
FIG. 7 is an illustration showing at least one preferred embodiments or fluid container and dispensing system 100 housed in rack 700.

FIG. 7 is an illustration showing at least one preferred embodiments or fluid container and dispensing system 100 housed in rack 700, before and after protective housing 110 has been removed. As discussed above, each fluid container and dispensing system 100 can contain a different type of bulk liquid or fluid 500 that all can be placed on shelves of a rack 700.

One of the advantages of fluid container and dispensing system 100 discussed above is that it is capable of storing a wide range of bulk liquids or fluids 500, such as, but not limited to, cleaning solution, industrial fluids, alcoholic beverages (e.g., wine) and non-alcoholic beverages (e.g., soft drinks, fruit juices). In fact, as shown in FIG. 7, a plurality of these fluids can be stored in a plurality of fluid container and dispensing systems 100 in rack 700. In addition to different labels on various surfaces (e.g., second surface 106, third surface 101, etc.) to identify the fluid contained therein, bulk liquids or fluids 500 can be colored with different coloring agents to provide color differentiation across varying types of fluids. The color of each bulk liquid or fluid 500 may also be discernible via openings 200 when bag 300 is filled (e.g., to a sufficient level 132). In fact, the color of bulk liquid or fluid 500 can correspond to labels affixed to the exterior surfaces (e.g., second surface 106) of the fluid container and dispensing system 100.

FURTHER MODIFICATIONS AND VARIATIONS

Although the invention has been described with reference to a specific embodiment, this description is not meant to be construed in a limiting sense. The example embodiments shown and described above are only exemplary. Various modifications of the disclosed embodiment as well as alternate embodiments of the invention will become apparent to persons skilled in the art upon reference to the description of the invention. For instance, many details are often found in the art such as: methods of forming cartons and boxes or the details of construction or forming liquid container. Thus, even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims. Accordingly, it should be understood that the modifications and variations suggested above and below are not intended to be exhaustive. These examples help show the scope of the inventive concepts, which are covered in the appended claims. The appended claims are intended to cover these modifications and alternate embodiments. In short, the restrictive description and drawings of the specific examples above are not intended to point out what an infringement of this of this patent would be, but are to provide at least one explanation of how to make and use the inventions contained herein. The limits of the inventions and the bounds of the patent protection are measured by and defined in the following claims.

What is claimed is:

1. An apparatus for containing and dispensing a fluid comprising:

(a) a collapsible container forming an interior volume to store varying amounts of said fluid, said collapsible container having a dispensing apparatus that selectively permits dispensing of said fluid from said collapsible container;

(b) a main housing forming an enclosed cavity to house said collapsible container, said main housing having a first surface with a first opening therein, said dispensing apparatus seated in said first opening, said first surface having a perimeter, said main housing comprised of corrugated cardboard material, said first surface having a single layer; and (c) a protective housing to protect said dispensing apparatus seated in said first opening of said first surface of said main housing, said protective housing having a perimeter edge that selectively joins with said perimeter of said first surface of said main housing, said protective housing comprised of corrugated cardboard material, said protective housing and said main housing formed out of a single sheet of corrugated cardboard material, said protective housing removably affixed to said main housing via said perimeter edge of said protective housing and said perimeter of said first surface of said main housing.

2. The apparatus of claim 1, wherein said fluid is selected from the group consisting of cleaning solutions, beverages, petroleum products, and chemicals.

3. The apparatus of claim 1, wherein said first surface has at least one opening through which said collapsible container can be viewed.

4. The apparatus of claim 1, wherein said dispensing apparatus comprises a measuring volume in communication with said interior volume of said collapsible container to measure an amount of said fluid selectively dispensed by said dispensing apparatus prior to dispensing said fluid from said interior volume of said collapsible container.

5. The apparatus of claim 1, wherein said dispensing apparatus is selected from the group consisting of a spigot, a nozzle, and a pump.

6. The apparatus of claim 1, wherein said main housing is structurally coupled to said protective housing via a perforated seam and said protective housing is selectively removable from said main housing.

7. The apparatus of claim 1, wherein said single sheet of corrugated cardboard material is glued to itself to partially create said enclosed cavity of said main housing.

8. The apparatus of claim 1, wherein said single sheet of corrugated cardboard material has a second surface and a third surface and said second surface is glued to said third surface at a first location to partially create said enclosed cavity of said main housing and said second surface are glued to said third surface at a second location to partially create said protective housing.

9. The apparatus of claim 1, wherein said main housing is also comprised of a second surface and a third surface, wherein said second surface and said third surface fold over one another to create a multi-layer portion that also creates part of said enclosed cavity of said main housing and further wherein said perimeter of said first surface has a first portion and said first opening having an opening perimeter that is tangential to said first portion of said perimeter of said first surface and said multi-layer portion encloses said opening perimeter that is tangential to said first portion of said perimeter of said first surface.

10. The apparatus of claim 1, wherein said first opening has an opening perimeter and further wherein said main housing having at least one flap that when folded is tangential to said opening perimeter and holds said dispensing apparatus in said opening.

11. The apparatus of claim 1, wherein said main housing is also comprised of a second surface, a third surface, a fourth surface, a fifth surface and a sixth surface that combine to form an enclosed box to store said collapsible container, and further wherein said first surface, said second surface, said third surface, said fourth surface, said fifth surface, and said sixth surface are substantially planer.

12. The apparatus of claim 11, further comprising a rack having at least one horizontal shelf to hold said main housing.

13. The apparatus of claim 1, wherein said collapsible container is comprised of a fluid-tight, transparent, flexible sheet material.

14. The apparatus of claim 13, wherein said fluid-tight, transparent, flexible sheet material is selected from a group consisting of nylons and plastics.

15. The apparatus of claim 1, wherein said perimeter of said first surface of said main housing has a first perimeter portion, said first opening having an opening perimeter, said opening perimeter tangential to said first perimeter portion of said perimeter of said first surface of said main housing.

16. The apparatus of claim 15, wherein said first perimeter portion is multilayered.

17. An apparatus, comprising:

(a) a box having a substantially planar top surface, a substantially planar bottom surface, a substantially planar first side surface, a substantially planar second side surface, a substantially planar first end surface, and a substantially planar second end surface, said box forming an internal cavity;

(b) a substantially planar partition surface positioned inside said box and adjoining said substantially planar first side surface, said substantially planar second side surface, said substantially planar top surface, and said substantially planar bottom surface, said substantially planar partition surface dividing said internal cavity into a first cavity and a second cavity, said first cavity housing a collapsible fluid container, said collapsible fluid container having a dispensing mechanism, said substantially planar partition surface having an opening positioned proximate to said substantially planar bottom surface, said dispensing mechanism extending through said opening into said second cavity and held in place by said substantially planar bottom surface; and (c) said substantially planar first side surface, said substantially planar second side surface, said substantially planar top surface, and said substantially planar bottom surface having openable seams formed on a geometric plane formed at an intersection of said substantially planar partition surface and said substantially planar first side surface, said substantially planar second side surface, said substantially planar top surface, and said substantially planar bottom surface, so that portions of said substantially planar first side surface, said substantially planar second side surface, said substantially planar top surface, and said substantially planar bottom surface can be selectively removed and so that said substantially planar first end surface can be selectively removed.

18. The apparatus of claim 17, wherein said dispensing mechanism is selected from a group consisting of a spigot, a nozzle, and a pump.

19. The apparatus of claim 17, wherein said collapsible fluid container holds fluid selected from a group consisting of cleaning solutions, beverages, petroleum products, and chemicals.

20. The apparatus of claim 17, wherein said substantially planar partition surface is a single layer.

21. The apparatus of claim 17, wherein said box and said substantially planar partition surface are formed from a single sheet of corrugated cardboard.

22. The apparatus of claim 21, wherein said substantially planar partition surface is glued to said substantially planar first side surface.

23. The apparatus of claim 17, wherein said substantially planar partition surface is glued to said substantially planar first side surface at only a first location.

24. The apparatus of claim 17, wherein said substantially planar second side surface is comprised of a first portion and a second portion which are glued to one another at a first location.

25. The apparatus of claim 17, wherein said substantially planar second side surface is comprised of a first side portion and a second side portion, further comprising a first glue joint in said internal cavity holding said substantially planar first side surface to said substantially planar partition and a second glue joint to glue said first side portion to said second side portion.

26. A method of making a container for shipping and dispensing bulk liquids comprising the steps of:

(a) manufacturing a container from a single sheet of corrugated cardboard material having a protective housing and a main housing with an opening therebetween, said protective housing forming a protective internal cavity, said main housing forming a main internal cavity, said protective housing is removable;

(b) positioning a fluid-tight, collapsible bag inside said main housing, said fluid-tight, collapsible bag having a spigot;

(c) filling said fluid-tight, collapsible bag with a liquid;

(d) extending said spigot through said opening so that said main internal cavity of said main housing is in fluid communication with said protective internal cavity of said protective housing via said spigot; and (e) closing said container such that said spigot is held in position via at least one flap of said container and whereby said container can be stacked and transported without damaging the spigot.

27. An apparatus, comprising:

(a) a first rectangular box; and (b) a second rectangular box joined to said first rectangular box via a perforated seam, said second rectangular selectably removable from said first rectangular box, said first rectangular box and said second rectangular box formed of a single sheet of sheet material.

28. The apparatus of claim 27, wherein said sheet material is corrugated cardboard.

29. An apparatus for containing and dispensing fluids comprising:

(a) a collapsible, fluid-tight bag having a bag internal volume for storing said fluids and at least one bag opening thereto;

(b) dispensing mechanism positioned in a first bag opening of said at least one bag opening for selectively dispensing fluid from said collapsible, fluid-tight bag; and (c) a rigid container having a container internal volume and a single layer partition to divide said container internal volume into a first chamber and a second chamber, said single layer partition having a container opening, said dispensing mechanism extending through said container opening and secured in said container opening by at least one flap that when folded helps create said container internal volume of said rigid container, said collapsible, fluid-tight bag positioned in said first chamber, wherein said second chamber is removable.

30. The apparatus of claim 29, wherein said collapsible, fluid-tight bag is formed of a flexible plastic material.

31. The apparatus of claim 29, wherein said rigid container is a six-sided, rectangular box and said single layer partition is a substantially planar surface dividing said six-sided, rectangular box into said first chamber and said second chamber, said container opening communicating between said first chamber and said second chamber is located near a low point of said first chamber whereby when said dispensing mechanism is positioned to extend through said container opening, fluid drains toward said dispensing mechanism.

32. The apparatus of claim 29, wherein said rigid container is formed of a single sheet of corrugated sheet material.

33. The apparatus of claim 29, wherein said rigid container is comprised of a single sheet of corrugated cardboard material which is glued to itself at a first location and at a second location to partially create said container internal volume.

34. The apparatus of claim 33, wherein said first location is positioned inside said container internal volume and said second location is positioned outside said container internal volume.

35. The apparatus of claim 29, wherein said dispensing mechanism is a spigot, said spigot having a neck mechanically coupled to said first bag opening of said at least one bag opening of said collapsible, fluid-tight bag, whereby said spigot is in fluid communication with said bag internal volume of said collapsible, fluid-tight bag.

36. The apparatus of claim 35, wherein said container opening has a perimeter and wherein said neck of said spigot has at least two spaced-apart flanges that engage said single-layer partition along said perimeter of said container opening to assist in retaining said spigot in position.

37. The apparatus of claim 35, further comprising a mechanism to remove said second chamber, said mechanism comprising a handhold to grab onto and remove said second chamber.

38. An apparatus, comprising:

(a) a box having a substantially planar top surface, a substantially planar bottom surface, a substantially planar first side surface, a substantially planar second side surface, a substantially planar first end surface, and a substantially planar second end surface, said box forming an internal cavity;

(b) a substantially planar partition surface positioned inside said box and adjoining said substantially planar first side surface, said substantially planar second side surface, said substantially planar top surface, and said substantially planar bottom surface, said substantially planar partition surface dividing said internal cavity into a first cavity and a second cavity, said first cavity housing a collapsible fluid container, said collapsible fluid container having a dispensing mechanism, said substantially planar partition surface having an opening positioned proximate to said substantially planar bottom surface, said dispensing mechanism extending through said opening into said second cavity and held in place by said substantially planar bottom surface; and (c) said substantially planar first side surface, said substantially planar second side surface, said substantially planar top surface, and said substantially planar bottom surface having openable seams formed at an intersection of a geometric plane upon which said substantially planar partition surface rests and said substantially planar first side surface, said substantially planar second side surface, said substantially planar top surface, and said substantially planar bottom surface, so that portions of said substantially planar first side surface, said substantially planar second side surface, said substantially planar top surface, and said substantially planar bottom surface can be selectively removed and so that said substantially planar first end surface can be selectively removed, wherein said substantially planar second side surface is comprised of a first side portion and a second side portion, further comprising a first glue joint in said internal cavity holding said substantially planar first side surface to said substantially planar partition surface and a second glue joint to glue said first side portion to said second side portion.

39. The apparatus of claim 38, wherein said dispensing mechanism is selected from a group consisting of a spigot, a nozzle, and a pump.

40. The apparatus of claim 38, wherein said collapsible fluid container holds fluid selected from a group consisting of cleaning solutions, beverages, petroleum products, and chemicals.

41. The apparatus of claim 38, wherein said substantially planar partition surface is a single layer.

42. The apparatus of claim 38, wherein said box and said substantially planar partition surface are formed from a single sheet of corrugated cardboard.

* * * * *